US011489283B2

(12) United States Patent
Lin et al.

(10) Patent No.: US 11,489,283 B2
(45) Date of Patent: Nov. 1, 2022

(54) ELECTRICAL CONNECTOR ASSEMBLY

(71) Applicant: Cheng Uei Precision Industry Co., LTD., New Taipei (TW)

(72) Inventors: Chun-Fu Lin, New Taipei (TW); Sheng-Nan Yu, New Taipei (TW); Chih-Chiang Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/352,248

(22) Filed: Jun. 18, 2021

(65) Prior Publication Data

US 2022/0131308 A1 Apr. 28, 2022

(30) Foreign Application Priority Data

Oct. 23, 2020 (CN) ..... 202022392816.7

(51) Int. Cl.

| | |
|---|---|
| ***H01R 13/516*** | (2006.01) |
| ***H01R 13/52*** | (2006.01) |
| ***H01R 13/6582*** | (2011.01) |
| ***H01R 31/06*** | (2006.01) |

(52) U.S. Cl.

CPC ..... *H01R 13/516* (2013.01); *H01R 13/5202* (2013.01); *H01R 13/6582* (2013.01); *H01R 31/06* (2013.01); *H01R 2201/26* (2013.01)

(58) Field of Classification Search

CPC .... H01R 13/11; H01R 13/113; H01R 13/502; H01R 13/642; H01R 2201/26; H01R 13/5202; H01R 13/516; H01R 13/6582; H01R 31/06

See application file for complete search history.

(56) References Cited

U.S. PATENT DOCUMENTS 8,062,075 B2 * 11/2011 Huang ..... H01R 13/53 439/701
10,714,854 B2 * 7/2020 Peng ..... H01R 13/641

* cited by examiner

*Primary Examiner* — Briggitte R. Hammond
(74) *Attorney, Agent, or Firm* — Cheng-Ju Chiang

(57) ABSTRACT

An electrical connector assembly includes a first connector, and a second connector docked with the first connector. The first connector includes a first insulating housing, a plurality of first signal terminals disposed in the first insulating housing, and a plurality of first power terminals disposed in the first insulating housing. Extension directions of the plurality of the first power terminals are multiple directions. The second connector includes a second insulating housing, a plurality of second signal terminals disposed in the second insulating housing, and a plurality of second power terminals disposed in the second insulating housing. Extension directions of the plurality of the second power terminals are multiple directions. The plurality of the first signal terminals are corresponding to the plurality of the second signal terminals. The plurality of the second power terminals correspondingly contact with the plurality of the first power terminals.

18 Claims, 10 Drawing Sheets

ELECTRICAL CONNECTOR ASSEMBLY

CROSS-REFERENCE TO RELATED APPLICATION

The present application is based on, and claims priority from, China Patent Application No. 202022392816.7, filed Oct. 23, 2020, the disclosure of which is hereby incorporated by reference herein in its entirety.

BACKGROUND OF THE INVENTION

1. Field of the Invention

The present invention generally relates to an electrical connector assembly, and more particularly to a vehicle-used electrical connector assembly.

2. The Related Art

Generally, a conventional electrical connector assembly includes an insulating housing, and a plurality of terminals assembled to the insulating housing. The insulating housing has a columnar section, and an annular groove surrounding the columnar section. The plurality of the terminals include a plurality of power terminals and a plurality of signal terminals. The columnar section has a mating face, and the columnar section has a plurality of lengthwise power terminal passageways and a plurality of signal terminal passageways penetrating through the mating face. The plurality of the signal terminal passageways are shown as pinhole shapes. The signal terminal passageways are located to two sides of the plurality of the power terminal passageways. The plurality of the power terminals are received in the plurality of the power terminal passageways, and the plurality of the signal terminals are received in the plurality of the signal terminal passageways.

The conventional electrical connector assembly includes a plug connector and a receptacle connector. The plurality of the power terminals are commonly arranged with a cross configuration area to make the plurality of the signal terminals located in opposite upper and lower sides of the plurality of the power terminals. The plurality of the power terminals and the signal terminals of the plug connector are of a blade type. The plurality of the power terminals and the signal terminals of the receptacle connector are of a clamp type, and each signal terminal of the receptacle connector has one clamping structure, and each power terminal of the receptacle connector has a pair of clamping structures arranged side by side.

However, the plurality of the power terminals and the plurality of the signal terminals of the conventional electrical connector assembly are exposed outside at the same time, so when the plug connector is engaged with the receptacle connector, the plurality of the power terminals easily collide with the plurality of the signal terminals to damage the conventional electrical connector assembly.

Thus, it is essential to provide an innovative electrical connector assembly having a plurality of power terminals and a plurality of signal terminals which are exposed outside at different times, and when a plug connector and a receptacle connector of the electrical connector assembly are docked, the plurality of the power terminals and the plurality of the signal terminals are easily assembled in proper positions to be protected, so that the plurality of the power terminals and the plurality of the signal terminals are hardly damaged.

SUMMARY OF THE INVENTION

An object of the present invention is to provide an electrical connector assembly. The electrical connector assembly includes a first connector, and a second connector docked with the first connector. The first connector includes a first insulating housing, a plurality of first signal terminals disposed in the first insulating housing, and a plurality of first power terminals disposed in the first insulating housing. A front end and a rear end of the first insulating housing are opened freely. A front end of each first signal terminal is exposed to the front end of the first insulating housing, and a rear end of each first signal terminal is exposed to the rear end of the first insulating housing. A front end of each first power terminal is exposed to the front end of the first insulating housing, and a rear end of each first power terminal is exposed to the rear end of the first insulating housing. Each first power terminal is shown as a flat plate shape. Extension directions of the plurality of the first power terminals in the first insulating housing are multiple directions and are arranged along a direction of a periphery of a polygon, and the plurality of the first power terminals surround the plurality of the first signal terminals. The second connector includes a second insulating housing, a plurality of second signal terminals disposed in the second insulating housing, and a plurality of second power terminals disposed in the second insulating housing. A front end and a rear end of the second insulating housing are opened freely. A front end of each second signal terminal is exposed to the front end of the second insulating housing, and a rear end of each second signal terminal is exposed to the rear end of the second insulating housing. A front end of each second power terminal is exposed to the front end of the second insulating housing, and a rear end of each second power terminal is exposed to the rear end of the second insulating housing. Each second power terminal is shown as a clamping structure. Extension directions of the plurality of the second power terminals in the second insulating housing are multiple directions and are arranged along the direction of the periphery of the polygon. The plurality of the second power terminals surround the plurality of the second signal terminals. The plurality of the first signal terminals are corresponding to the plurality of the second signal terminals. The plurality of the second power terminals correspondingly contact with and clamp the plurality of the first power terminals.

Another object of the present invention is to provide an electrical connector assembly. The electrical connector assembly includes a first connector, and a second connector docked with the first connector. The first connector includes a first insulating housing, a plurality of first signal terminals disposed in the first insulating housing, and a plurality of first power terminals disposed in the first insulating housing. A front end of each first signal terminal is exposed to a front end of the first insulating housing. The plurality of the first power terminals surround and are spaced from the plurality of the first signal terminals. A front end of each first power terminal is exposed to the front end of the first insulating housing. Extension directions of the plurality of the first power terminals are different, and an angle is formed between each two first power terminals in the first insulating housing. The second connector includes a second insulating housing, a plurality of second signal terminals disposed in the second insulating housing, and a plurality of second power terminals disposed in the second insulating housing. A rear end of each second signal terminal is exposed to a rear end of the second insulating housing. The plurality of the second power terminals surround and are spaced from the plurality of the second signal terminals. A rear end of each second power terminal is exposed to the rear end of the second insulating housing. Extension directions of the plurality of the second power terminals in the second insulating housing are different, so the angle is formed between each two second power terminals in the second insulating housing. The front ends of the plurality of the first signal terminals are corresponding to the rear ends of the plurality of the second signal terminals, and the rear ends of the plurality of the second power terminals correspondingly contact with the front ends of the plurality of the first power terminals.

Another object of the present invention is to provide an electrical connector assembly. The electrical connector assembly includes a first connector, and a second connector docked with the first connector. The first connector includes a first insulating housing, a plurality of first signal terminals disposed in the first insulating housing, and a plurality of first power terminals disposed in the first insulating housing. The first insulating housing has a first base body. The first base body has a first docking surface, and a first connecting surface opposite to the first docking surface. A middle of the first docking surface of the first base body extends frontward to form a docking portion. The middle of the first docking surface of the first base body extends frontward to form a protrusion. The docking portion surrounds and is spaced from the protrusion. The docking portion and the first base body surround a fastening groove between the docking portion and the first docking surface of the first base body. A front end of each first signal terminal has a first contact portion. The first contact portion of each first signal terminal is disposed in the protrusion. The plurality of the first power terminals surround and are spaced from the plurality of the first signal terminals. Extension directions of the plurality of the first power terminals in the first insulating housing are at least three directions, and an angle is formed between each two first power terminals in the first insulating housing. A front end of each first power terminal has a second contact portion. The second contact portion of each first power terminal is exposed to the fastening groove of the first insulating housing. The second connector includes a second insulating housing, a plurality of second signal terminals disposed in the second insulating housing, and a plurality of second power terminals disposed in the second insulating housing. The second insulating housing has a second base body. The second base body has a second docking surface, and a second connecting surface opposite to the second docking surface. A middle of the second docking surface is recessed inward and towards an inside of the second base body to form a receiving groove. A middle of a front wall of the receiving groove protrudes rearward to form a bearing portion. The fastening groove is corresponding to the bearing portion. The docking portion is corresponding to the receiving groove. A middle of a rear surface of the bearing portion is recessed inward and towards the inside of the second base body to form a docking groove. The protrusion is corresponding to and matched with the docking groove. A rear end of each second signal terminal has a third contact portion. The third contact portion of each second signal terminal is exposed to the docking groove. The plurality of the second power terminals surround and are spaced from the plurality of the second signal terminals. Extension directions of the plurality of the second power terminals in the second insulating housing are at least three directions, so the angle is formed between each two second power terminals in the second insulating housing. A rear end of each second power terminal has a clamping portion. The clamping portion of each second power terminal is disposed in the bearing portion. The clamping portions of the plurality of the second power terminals clamp the second contact portions of the plurality of the first power terminals. The third contact portions of the plurality of the second signal terminals are corresponding to the first contact portions of the plurality of the first signal terminals.

As described above, the first contact portion of each first signal terminal is disposed in the protrusion of the first insulating housing, the second contact portion of each first power terminal is exposed to the fastening groove of the first insulating housing, so the plurality of the first signal terminals and the plurality of the first power terminals are exposed outside at different time, the plurality of the first signal terminals are disposed among the plurality of the first power terminals, each first power terminal has a shielding function for isolating an external signal interference to prevent each first signal terminal from being interfered, and simultaneously, the third contact portion of each second signal terminal is exposed to the docking groove of the second insulating housing, the clamping portion of each second power terminal is disposed in a second power terminal groove of the bearing portion, so the plurality of the second signal terminals and the plurality of the second power terminals are exposed outside at the different time, the plurality of the second signal terminals are disposed among the plurality of the second power terminals, each second power terminal has a shielding function for isolating an external signal interference to prevent each second signal terminal from being interfered. Moreover, when the first connector is docked with the second connector, the plurality of the first signal terminals are corresponding to the plurality of the second signal terminals, the plurality of the first power terminals correspondingly contact with and clamp the plurality of the second power terminals, the protrusion of the first insulating housing is corresponding to the docking groove of the second insulating housing, and the protrusion is received in the docking groove. The front ends of the plurality of the first signal terminals are corresponding to the rear ends of the plurality of the second signal terminals, and the rear ends of the plurality of the second power terminals correspondingly contact with and clamp the front ends of the plurality of the first power terminals. As a result, the electrical connector assembly has a plurality of the power terminals and a plurality of the signal terminals exposed outside at the different time, so the plurality of the power terminals and the plurality of the signal terminals are easily assembled in proper positions to be protected, positions of the first connector and the second connector are aligned easily at the time of the first connector being docked with the second connector to further protect the plurality of the signal terminals and the power terminals to make the plurality of the signal terminals and the power terminals be hardly damaged.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
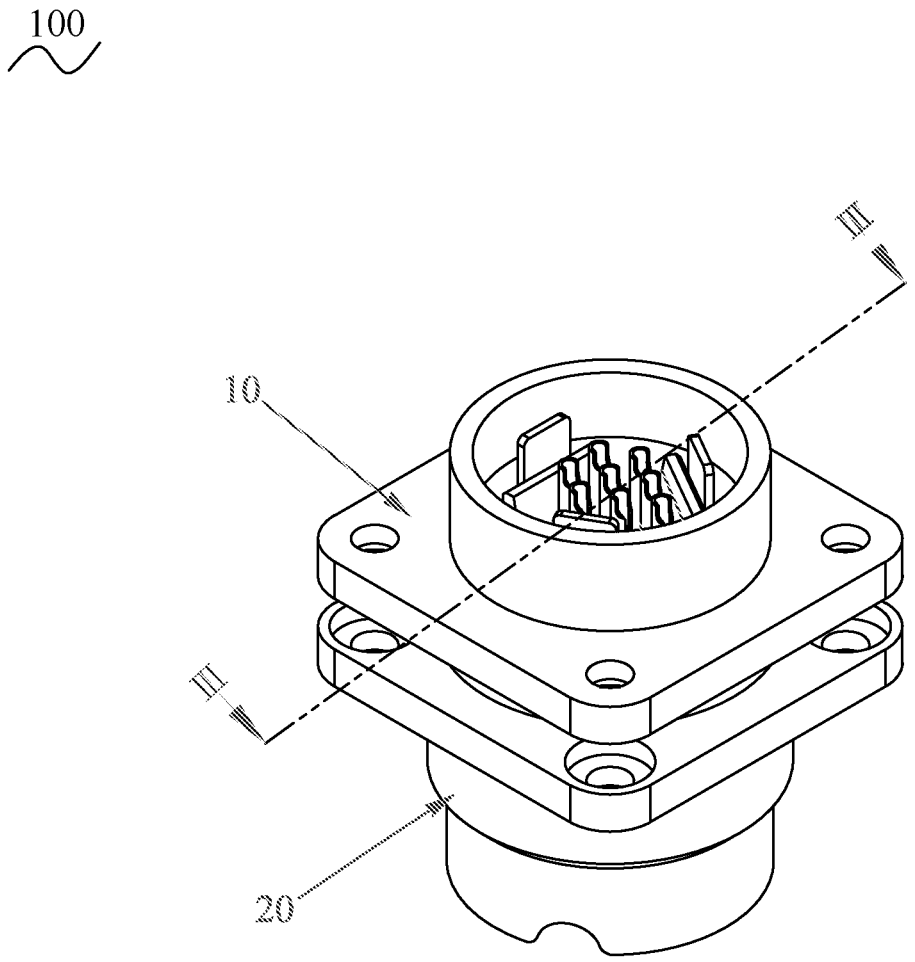
FIG. 1 is a perspective view of an electrical connector assembly in accordance with a preferred embodiment of the present invention.
Figure 2:
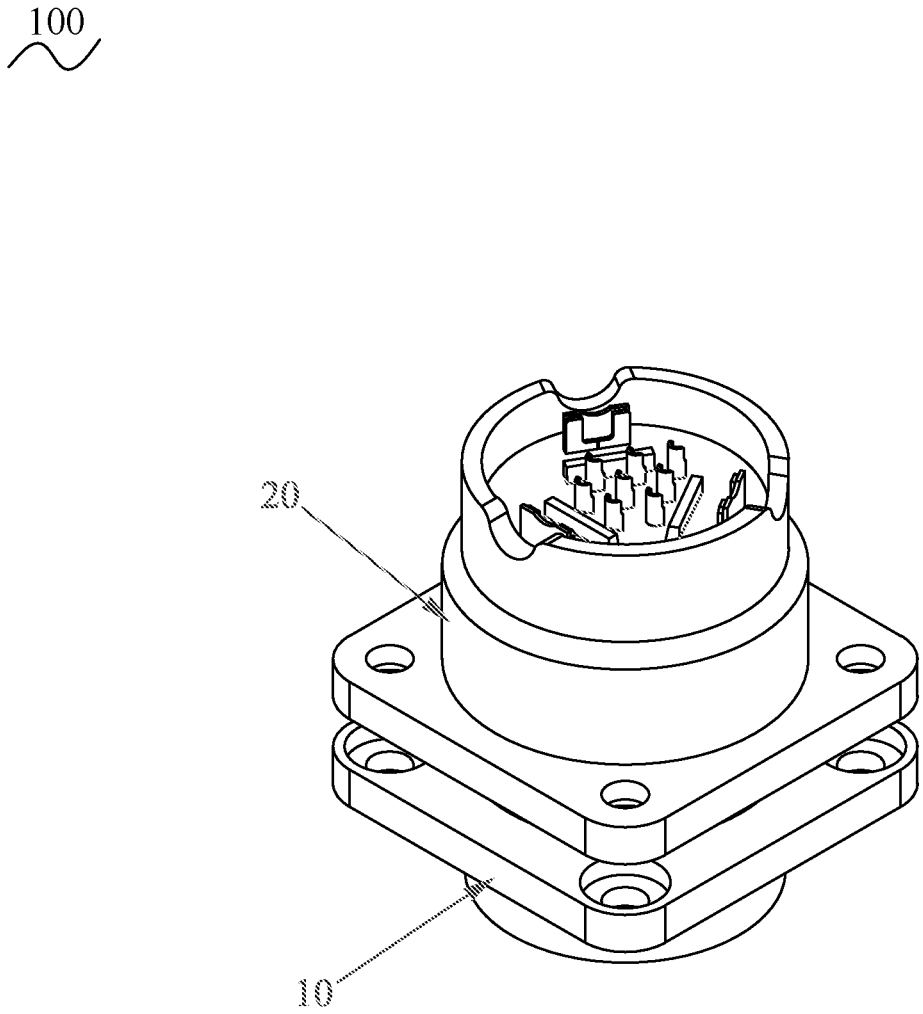
FIG. 2 is another perspective view of the electrical connector assembly of FIG. 1.
Figure 3:
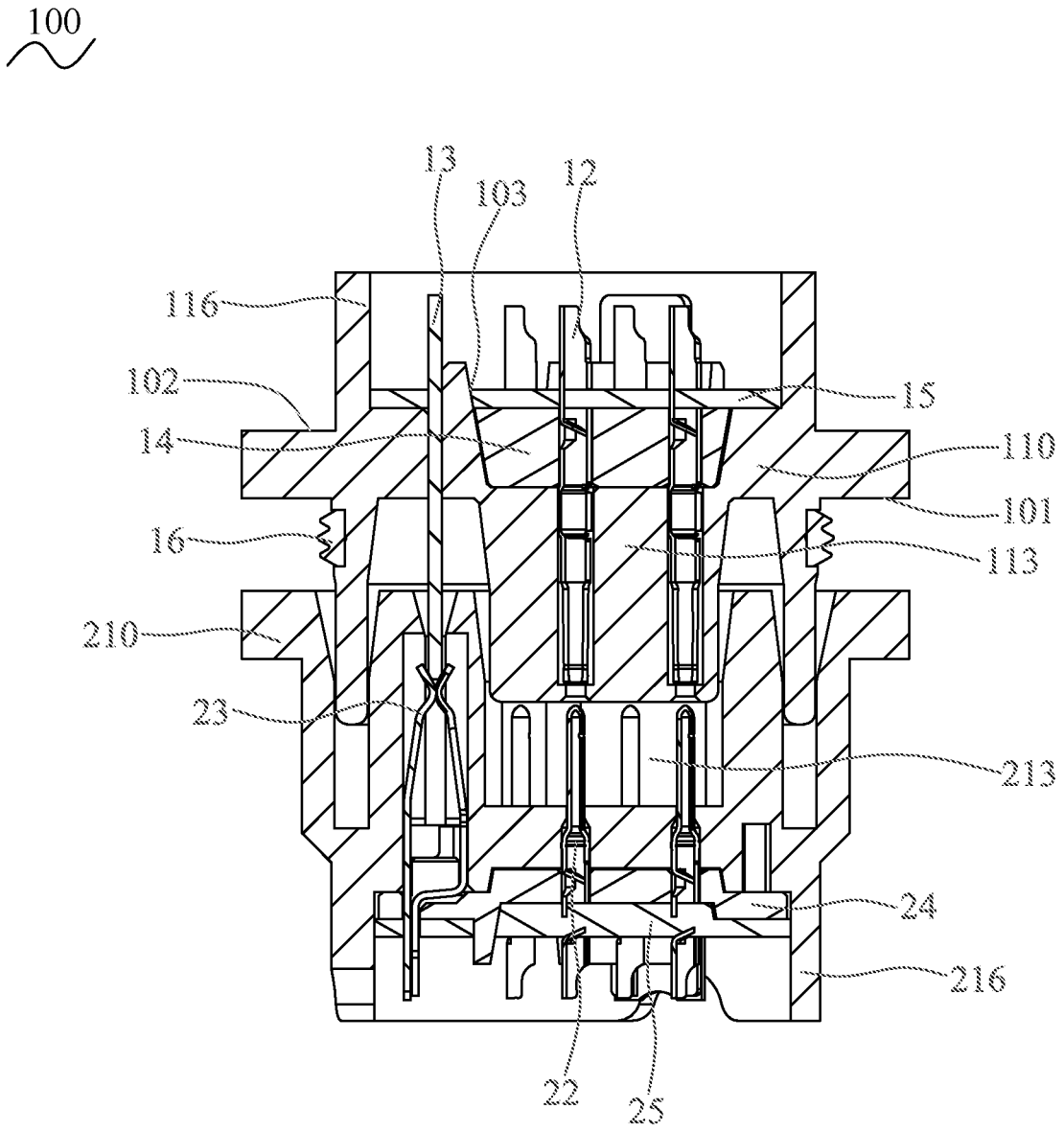
FIG. 3 is a sectional diagram of the electrical connector assembly along a line of FIG. 1.
Figure 4:
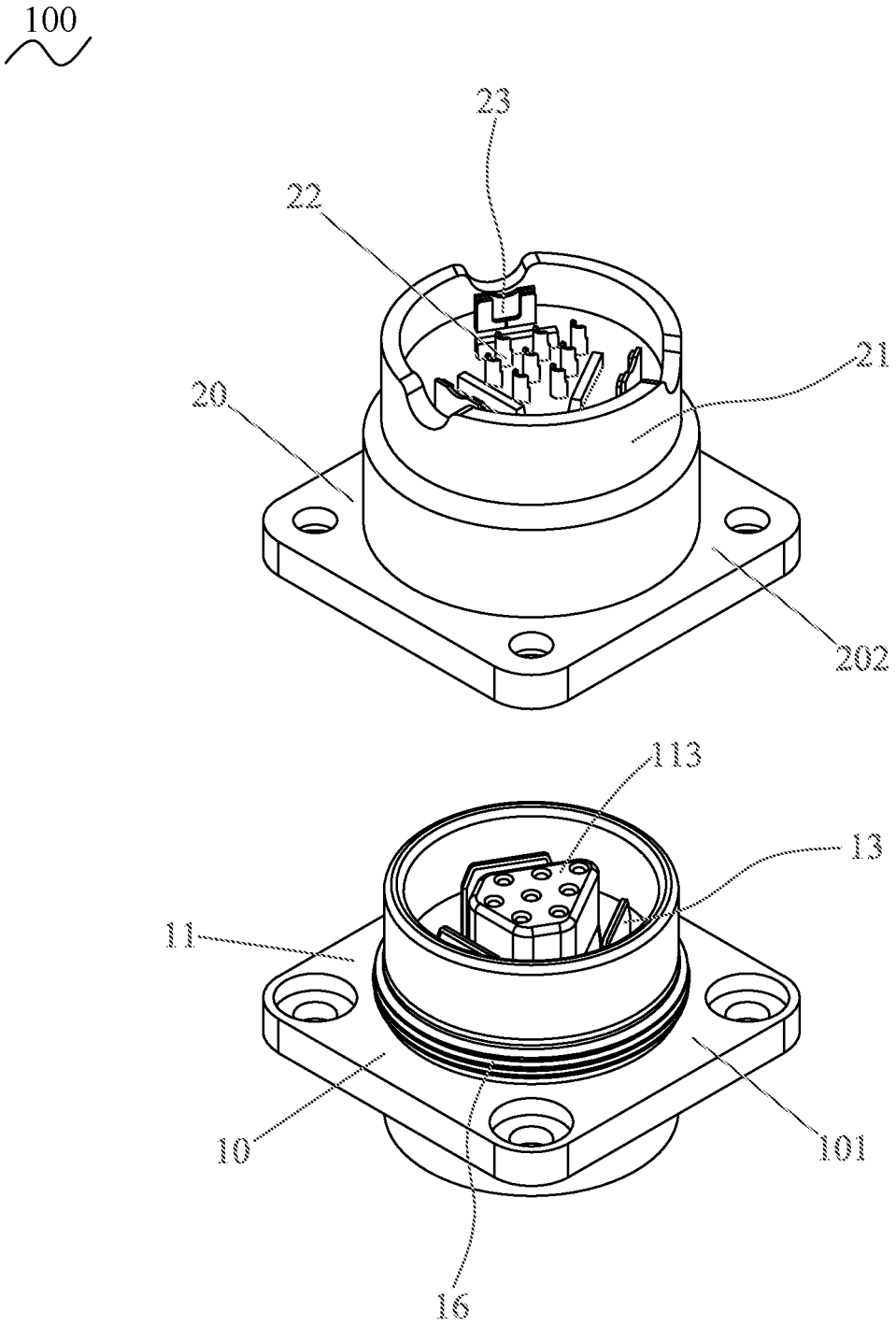
FIG. 4 is an exploded view of the electrical connector assembly of FIG. 1.
Figure 5:
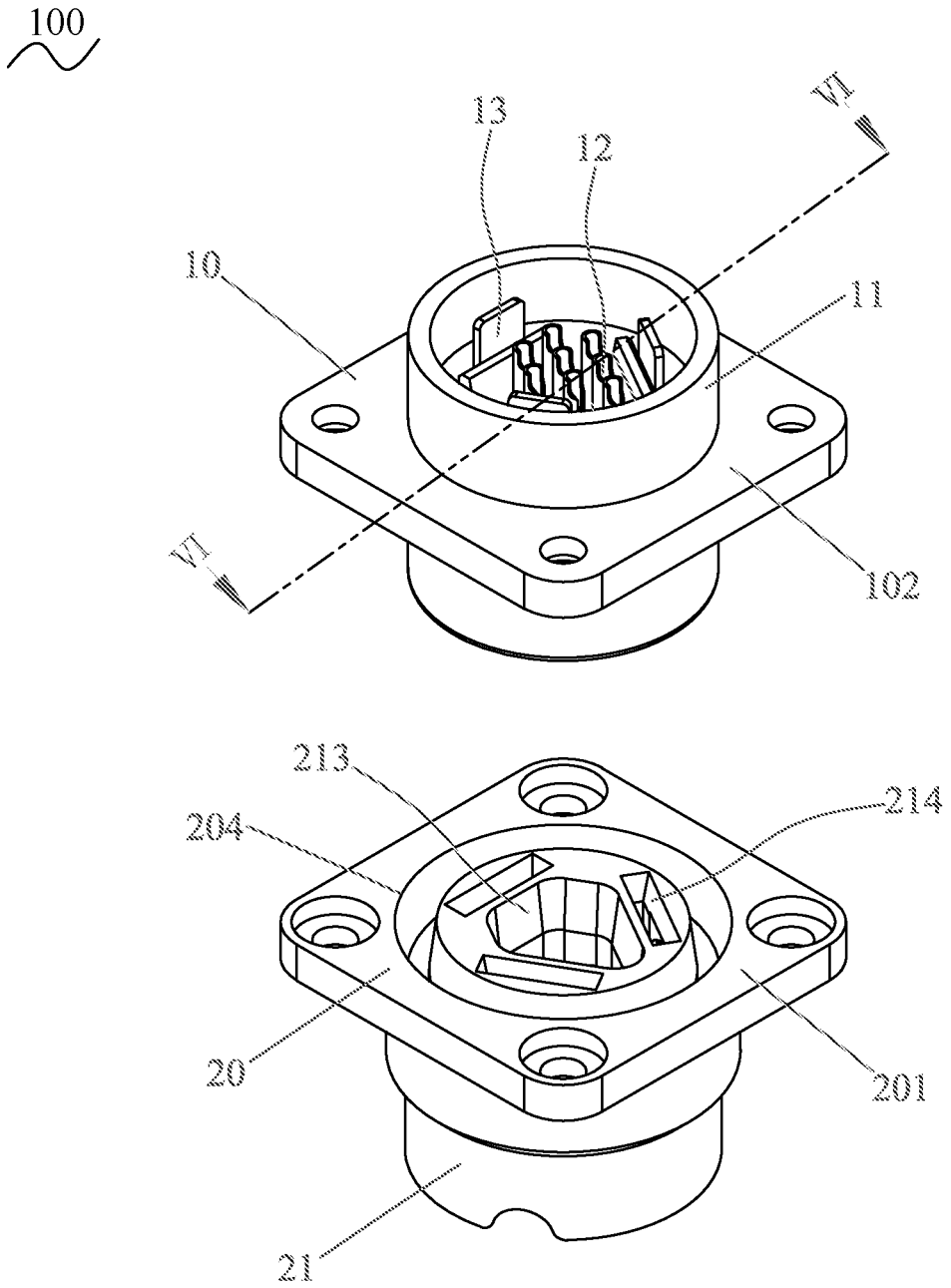
FIG. 5 is another exploded view of the electrical connector assembly of FIG. 1.
Figure 6:
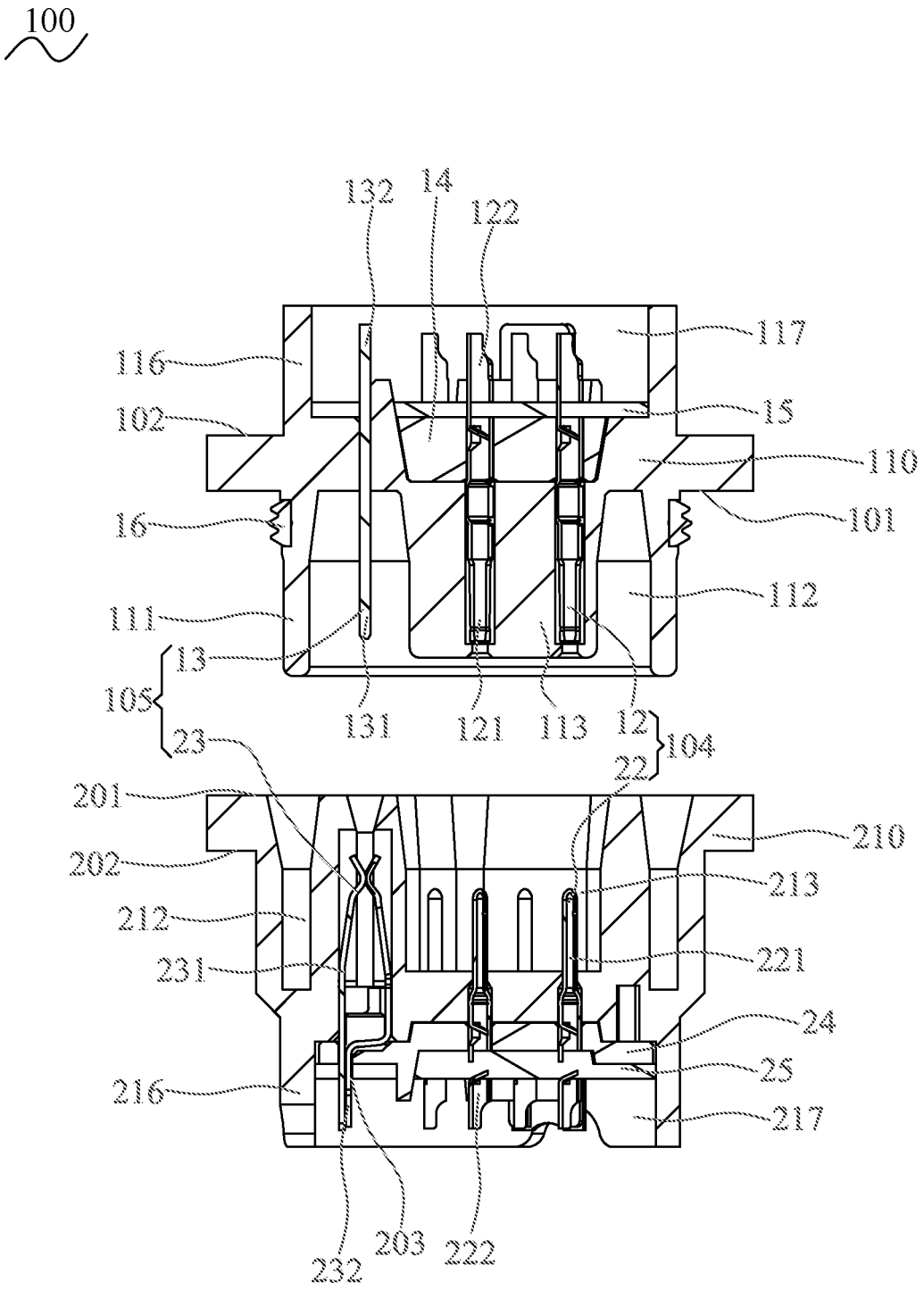
FIG. 6 is a sectional diagram of the electrical connector assembly along a line VI-VI of FIG. 5.

With reference to FIG. 1 to FIG. 3, an electrical connector assembly 100 in accordance with a preferred embodiment of the present invention is shown. The electrical connector assembly 100 includes a first connector 10, and a second connector 20 docked with the first connector 10.

With reference to FIG. 3 to FIG. 8, the first connector 10 includes a first insulating housing 11, a plurality of first signal terminals 12, a plurality of first power terminals 13, a first back cover 14, a first glue body 15 and a sealing ring 16. The plurality of the first signal terminals 12, the plurality of the first power terminals 13, the first back cover 14 and the first glue body 15 are disposed in the first insulating housing 11. A front end and a rear end of the first insulating housing 11 of the first connector 10 are opened freely. The sealing ring 16 is mounted around a middle of an outside of the first insulating housing 11. The plurality of the first power terminals 13 surround and are spaced from the plurality of the first signal terminals 12. The plurality of the first signal terminals 12 are disposed among the plurality of the first power terminals 13. Each first power terminal 13 has a shielding function for isolating an external signal interference to prevent each first signal terminal 12 from being interfered. The first back cover 14 is used for fastening the plurality of the first signal terminals 12. The first glue body 15 has a waterproof function.

With reference to FIG. 1 to FIG. 3, when the first connector 10 is docked with the second connector 20, the sealing ring 16 is located between the first connector 10 and the second connector 20. The sealing ring 16 is used for preventing water from flowing into the first connector 10 or the second connector 20. In the preferred embodiment, the first connector 10 includes eight first signal terminals 12 and three first power terminals 13. The three first power terminals 13 are able to transmit a power signal and a ground signal. Preferably, the three first power terminals 13 are used for transmitting the power signal and the ground signal.

Referring to FIG. 1 to FIG. 8, the first insulating housing 11 has a first base body 110, a docking portion 111, a fastening groove 112, a protrusion 113, a plurality of first power terminal grooves 114, a plurality of first signal terminal grooves 115, a first peripheral wall 116, a fixing groove 117, a first concave surface 118 and a plurality of first blocking walls 119. The first base body 110 is shown as a substantially square shape from a front view. The first base body 110 has a first docking surface 101, and a first connecting surface 102 opposite to the first docking surface 101. The first base body 110 has a front surface defined as the first docking surface 101, and a rear surface defined as the first connecting surface 102. The docking portion 111 is shown as a hollow cylinder shape. A middle of the first docking surface 101 of the first base body 110 extends forward and towards the second connector 20 to form the docking portion 111. The sealing ring 16 is mounted around an outer surface of the docking portion 111.

The hollow docking portion 111 and the first base body 110 surround the fastening groove 112 between the docking portion 111 and the first docking surface 101 of the first base body 110. The fastening groove 112 is corresponding to a corresponding mechanism of the second connector 20. The middle of the first docking surface 101 of the first base body 110 extends frontward and towards the second connector 20 to form the protrusion 113. The protrusion 113 is shown as a substantially triangle shape from a front view. In this case, the protrusion 113 is shown as a substantially diamond shape from the front view. The docking portion 111 surrounds and is spaced from the protrusion 113. The protrusion 113 is disposed in the fastening groove 112. The protrusion 113 is used for being docked with the corresponding mechanism of the second connector 20, so positions of the first connector 10 and the second connector 20 are aligned easily at the time of the first connector 10 being docked with the second connector 20 to protect a plurality of signal terminals 104 to make the plurality of the signal terminals 104 be uneasily damaged.

The first base body 110 has the plurality of the first power terminal grooves 114 penetrating through the first docking surface 101 and the first connecting surface 102 of the first base body 110. The plurality of the first power terminal grooves 114 are disposed inside the docking portion 111. Front ends of the plurality of the first power terminal grooves 114 are located in the fastening groove 112. The protrusion 113 is disposed among the plurality of the first power terminal grooves 114. The plurality of the first power terminals 13 are corresponding to the plurality of the first power terminal grooves 114. A quantity of the plurality of the first power terminals 13 and a quantity of the plurality of the first power terminal grooves 114 are the same. The plurality of the first power terminals 13 are disposed to and penetrate through the plurality of the first power terminal grooves 114. A front end of each first power terminal 13 is exposed in the fastening groove 112 of the docking portion 111.

In the preferred embodiment, the first base body 110 has three first power terminal grooves 114 averagely distributed in the first base body 110. The first insulating housing 11 has the plurality of the first signal terminal grooves 115 penetrating through a front surface of the protrusion 113 and the first connecting surface 102 of the first base body 110. Front ends of the plurality of the first signal terminals 12 are disposed in the plurality of the first signal terminal grooves 115 and are surrounded by the protrusion 113. Rear ends of the plurality of the first signal terminals 12 penetrate through the plurality of the first signal terminal grooves 115 and are exposed beyond the first connecting surface 102 of the first base body 110. The three first power terminals 13 surround the protrusion 113. The three first power terminals 113 are arranged beside at least three major sides of the protrusion 113. Each first power terminal 113 is shown as a blade shape. Each first power terminal 13 is a blade-type terminal.

Referring to FIG. 1 to FIG. 8 again, a middle of the first connecting surface 102 of the first base body 110 extends rearward to form the first peripheral wall 116. The first peripheral wall 116 is shown as an annular shape. The first back cover 14 and the first glue body 15 are disposed inside the first peripheral wall 116. The first peripheral wall 116 is used for conveniently dispensing glue to each of the plurality of the first signal terminals 12 and the first power terminals 13 and protecting the plurality of the first signal terminals 12 and the first power terminals 13. The first peripheral wall 116 is hollow. The first insulating housing 11 has the fixing groove 117 formed between an inner surface of the first peripheral wall 116 and the first connecting surface 102 of the first base body 110. The middle of the first connecting surface 102 of the first base body 110 is recessed inward to form the first concave surface 118 opposite to the docking portion 111. The first concave surface 118 is shown as a trilateral shape. The first concave surface 118 is corresponding to the protrusion 113. The first concave surface 118 is surrounded by the first peripheral wall 116 and the first base body 110. The first concave surface 118 is formed to an inner surface of a front wall of the fixing groove 117. The first back cover 14 is matched with the first concave surface 118, and the first back cover 14 is fastened on the first concave surface 118 and is fastened in the first insulating housing 11. The plurality of the first signal terminal grooves 115 penetrate through the first concave surface 118.

Several portions of the middle of the first connecting surface 102 of the first base body 110 extend rearward to form the plurality of the first blocking walls 119. The plurality of the first blocking walls 119 are disposed inside the first peripheral wall 116, and the plurality of the first blocking walls 119 are disposed in the fixing groove 117. The first concave surface 118 is disposed among the plurality of the first blocking walls 119. The plurality of the first blocking walls 119 are surrounded by the plurality of the first power terminals 13. The plurality of the first blocking walls 119 are arranged beside three sides of the first concave surface 118. The plurality of the first blocking walls 119 are arranged beside the plurality of the first power terminals 13. The quantity of the plurality of the first power terminals 13 is corresponding to a quantity of the plurality of the first blocking walls 119, and each first blocking wall 119 is corresponding to and adjacent to one first power terminal 13. Outer surfaces of the plurality of the first blocking walls 119 are disposed adjacent to inner surfaces of the plurality of the first power terminals 13. The plurality of the first signal terminals 12 are surrounded by the plurality of the first blocking walls 119. The plurality of the first blocking walls 119 are disposed between the plurality of the first signal terminals 12 and the plurality of the first power terminals 13. Each first blocking wall 119 is used for reducing a wire overlap soldering and increasing a creepage distance.

Referring to FIG. 5 to FIG. 8, the plurality of the first signal terminals 12 are assembled to the first insulating housing 11. Each first signal terminal 12 has a first contact portion 121 and a first soldering portion 122. In the preferred embodiment, each first signal terminal 12 is shown as a tube shape. The first contact portion 121 of each first signal terminal 12 is a clamping structure. A front end and a rear end of each first signal terminal 12 are opened freely. A middle of each first signal terminal 12 is hid in a middle of the first insulating housing 11. The front end of each first signal terminal 12 is received in one first signal terminal groove 115 and is exposed to the front end of the first insulating housing 11, and the rear end of each first signal terminal 12 is exposed to the rear end of the first insulating housing 11. The rear end of each first signal terminal 12 is exposed to the fixing groove 117 of the first insulating housing 11. The front end of each first signal terminal 12 has the first contact portion 121 extending towards a second insulating housing 21 of the second connector 20. The front end of each first signal terminal 12 is disposed in the protrusion 113. The first contact portion 121 of each first signal terminal 12 is disposed in the protrusion 113. The first contact portion 121 of each first signal terminal 12 is corresponding to a corresponding structure of the second connector 20. The rear end of each first signal terminal 12 has the first soldering portion 122 extending towards an inside of the first peripheral wall 116. The first soldering portion 122 of each first signal terminal 12 penetrates through the first concave surface 118 and the first connecting surface 102 of the first insulating housing 11. The first soldering portion 122 of each first signal terminal 12 is used for being soldered with a wire. In the preferred embodiment, the first soldering portion 122 of each first signal terminal 12 is partially exposed out of an outer surface of the first glue body 15. The first soldering portion 122 of each first signal terminal 12 is exposed to and projects beyond a rear surface of the first glue body 15.

The plurality of the first power terminals 13 are assembled to the first insulating housing 11. In the preferred embodiment, each first power terminal 13 is shown as a flat plate shape and is disposed longitudinally. Each first power terminal 13 has a second contact portion 131 and a second soldering portion 132. The front end of each first power terminal 13 has the second contact portion 131 extending towards the second insulating housing 21 of the second connector 20. The second contact portion 131 of each first power terminal 13 is exposed to the fastening groove 112 of the first insulating housing 11. The second contact portion 131 of each first power terminal 13 is corresponding to a corresponding part of the second connector 20. A rear end of each first power terminal 13 has the second soldering portion 132 extending towards the inside of the first peripheral wall 116. The second soldering portion 132 of each first power terminal 13 penetrates through the first connecting surface 102 of the first insulating housing 11. The front end of each first power terminal 13 is exposed to the front end of the first insulating housing 11, and the rear end of each first power terminal 13 is exposed to the rear end of the first insulating housing 11. The second soldering portion 132 of each first power terminal 13 is used for being soldered with the wire. In the preferred embodiment, the second soldering portion 132 of each first power terminal 13 is partially exposed out of the outer surface of the first glue body 15. The second soldering portion 132 of each first power terminal 13 is exposed to and projects beyond the rear surface of the first glue body 15.

In the preferred embodiment, widths of the plurality of the second contact portions 131 of the plurality of the first power terminals 13 are wider than widths of the plurality of the second soldering portions 132 of the plurality of the first power terminals 13. The plurality of the first power terminals 13 are without being parallel to one another, and the plurality of the first power terminals 13 are without being perpendicular to one another. The plurality of the first power terminals 13 are disposed in the first insulating housing 11 along different angles with respect to a horizontal plane. The extension directions of the plurality of the first power terminals 13 are different, each direction is formed by an angle which is formed between each two first power terminals 13 in the first insulating housing 11. The extension directions of the plurality of the first power terminals 13 in the first insulating housing 11 are at least three directions.

The first back cover 14 is disposed on the first concave surface 118 of the first insulating housing 11. The first back cover 14 is used for fastening the plurality of the first signal terminals 12. The first back cover 14 has a plurality of first perforations 141 penetrating through a front surface and a rear surface of the first back cover 14. The plurality of the first perforations 141 are corresponding to the plurality of the first signal terminal grooves 115 and the plurality of the first signal terminals 12. A quantity of the plurality of the first perforations 141, a quantity of the plurality of the first signal terminal grooves 115 and a quantity of the plurality of the first signal terminals 12 are the same. The first soldering portions 122 of the plurality of the first signal terminals 12 penetrate through the plurality of the first perforations 141 and are partially exposed out of the outer surface of the first glue body 15. In the preferred embodiment, the first back cover 14 has eight first perforations 141.

The first glue body 15 is disposed inside the first peripheral wall 116 of the first insulating housing 11 and is covered to the first back cover 14. The first glue body 15 fills up first gaps 103 among the plurality of the first signal terminals 12, the plurality of the first power terminals 13 and the plurality of the first blocking walls 119 of the first insulating housing 11. The first glue body 15 is used for providing the waterproof function of the first connector 10. The first glue body 15 has a plurality of first penetrating grooves 151 penetrating through a front surface and the rear surface of the first glue body 15. The plurality of the first penetrating grooves 151 are averagely distributed in the first glue body 15. The plurality of the first penetrating grooves 151 are corresponding to the plurality of the first power terminal grooves 114 and the plurality of the first power terminals 13. A quantity of the plurality of the first penetrating grooves 151, the quantity of the plurality of the first power terminal grooves 114 and the quantity of the plurality of the first power terminals 13 are the same. The second soldering portions 132 of the plurality of the first power terminals 13 penetrate through the plurality of the first penetrating grooves 151. In the preferred embodiment, the first glue body 15 has three first penetrating grooves 151 averagely distributed in the first glue body 15. The first soldering portions 122 of the plurality of the first signal terminals 12, the second soldering portions 132 of the plurality of the first power terminals 13 and the plurality of the first blocking walls 119 are exposed out of the outer surface of the first glue body 15.

Referring to FIG. 3 to FIG. 10, the second connector 20 is docked with the first connector 10. The second connector 20 includes a second insulating housing 21, a plurality of second signal terminals 22, a plurality of second power terminals 23, a second back cover 24 and a second glue body 25. The plurality of the second signal terminals 22, the plurality of the second power terminals 23, the second back cover 24 and the second glue body 25 are disposed in the second insulating housing 21. A front end and a rear end of the second insulating housing 21 are opened freely. The plurality of the second power terminals 23 surround and are spaced from the plurality of the second signal terminals 22. The plurality of the second signal terminals 22 are disposed among the plurality of the second power terminals 23. Each second power terminal 23 has a shielding function for isolating an external signal interference to prevent each second signal terminal 22 from being interfered. The second back cover 24 is used for fastening the plurality of the second signal terminals 22. The second glue body 25 has a waterproof function of the second connector 20. The plurality of the second signal terminals 22 are corresponding to the plurality of the first signal terminals 12. The plurality of the second power terminals 23 are corresponding to the plurality of the first power terminals 13. In the preferred embodiment, the second connector 20 includes eight second signal terminals 22 and three second power terminals 23.

Referring to FIG. 7 to FIG. 10, the second insulating housing 21 has a second base body 210, a bearing portion 211, a receiving groove 212, a docking groove 213, a plurality of second power terminal grooves 214, a plurality of second signal terminal grooves 215, a second peripheral wall 216, a locating groove 217 and a second concave surface 218. The second base body 210 is shown as the substantially square shape from a rear view. The second base body 210 has a second docking surface 201, and a second connecting surface 202 opposite to the second docking surface 201. The second base body 210 has a rear surface defined as the second docking surface 201, and a front surface defined as the second connecting surface 202. A middle of the second docking surface 201 of the second base body 210 is recessed inward and towards an inside of the second base body 210 to form the receiving groove 212. A middle of a front wall of the receiving groove 212 protrudes rearward to form the bearing portion 211 disposed in the receiving groove 212 and spaced from an inner surface of a surrounding wall 204 of the receiving groove 212. The fastening groove 112 of the first insulating housing 11 is corresponding to the bearing portion 211. The docking portion 111 of the first insulating housing 11 is corresponding to the receiving groove 212. A middle of a rear surface of the bearing portion 211 is recessed inward and towards the inside of the second base body 210 to form the docking groove 213. The protrusion 113 of the first insulating housing 11 is corresponding to and matched with the docking groove 213, so the protrusion 113 is received in the docking groove 213 and the positions of the first connector 10 and the second connector 20 are aligned easily at the time of the first connector 10 being docked with the second connector 20 to protect the plurality of the signal terminals 104 to make the plurality of the signal terminals 104 be uneasily damaged. The plurality of the signal terminals 104 include the plurality of the first signal terminals 12 and the plurality of the second signal terminals 22. The electrical connector assembly 100 includes a plurality of power terminals 105 which include the plurality of the first power terminals 13 and the plurality of the second power terminals 23. The plurality of the signal terminals 104 and the power terminals 105 of the electrical connector assembly 100 are partially exposed outside at different positions, so the positions of the first connector 10 and the second connector 20 are aligned easily at the time of the first connector 10 being docked with the second connector 20 to protect the plurality of the signal terminals 104 and the power terminals 105 to make the plurality of the signal terminals 104 and the power terminals 105 be uneasily damaged.

Rear ends of the plurality of the second signal terminals 22 are exposed to the docking groove 213. The second insulating housing 21 has the plurality of the second power terminal grooves 214 penetrating through a rear surface of the bearing portion 211 and the second connecting surface 202 of the second base body 210. The docking groove 213 is disposed among the plurality of the second power terminal grooves 214. The plurality of the second power terminals 23 are corresponding to the plurality of the second power terminal grooves 214. A quantity of the plurality of the second power terminals 23 and a quantity of the plurality of the second power terminal grooves 214 are the same. The plurality of the second power terminals 23 are disposed in the plurality of the second power terminal grooves 214. In the preferred embodiment, the second insulating housing 21 has three second power terminal grooves 214 averagely distributed the bearing portion 211. The plurality of the second signal terminal grooves 215 penetrate through the second docking surface 201 and the second connecting surface 202 of the second base body 210. The plurality of the second signal terminal grooves 215 further penetrate through a front wall of the docking groove 213. The plurality of the second signal terminals 22 are disposed in the plurality of the second signal terminal grooves 215.

A middle of the second connecting surface 202 of the second base body 210 protrudes frontward to form the second peripheral wall 216. The second peripheral wall 216 is shown as another annular shape. The second back cover 24 and the second glue body 25 are disposed inside the second peripheral wall 216. The second peripheral wall 216 is used for conveniently dispensing glue to each of the plurality of the second signal terminals 22 and the second power terminals 23 and protecting the plurality of the second signal terminals 22 and the second power terminals 23. The second peripheral wall 216 is hollow. An inside of the second peripheral wall 216 has the locating groove 217 recessed towards the second base body 210 and connected with an outside. The second concave surface 218 is formed in an inner surface of a rear wall of the locating groove 217. A middle of the inner surface of the rear wall of the locating groove 217 is recessed inward and towards the second base body 210 to form the second concave surface 218. A middle of a front surface of the rear wall of the locating groove 217 is recessed inward and towards the second base body 210 to form the second concave surface 218. The second concave surface 218 is disposed inside the second peripheral wall 216. The second concave surface 218 is corresponding to and matched with a corresponding portion of the second back cover 24. A middle of a rear of the second back cover 24 is matched with the second concave surface 218. The middle of the rear of the second back cover 24 is mounted on the second concave surface 218, and the rest of the second back cover 24 is fastened to the rear wall of the locating groove 217, so the second back cover 24 is fastened in the second peripheral wall 216 of the second insulating housing 21. The plurality of the second signal terminal grooves 215 further penetrate through the second concave surface 218.

Figure 7:
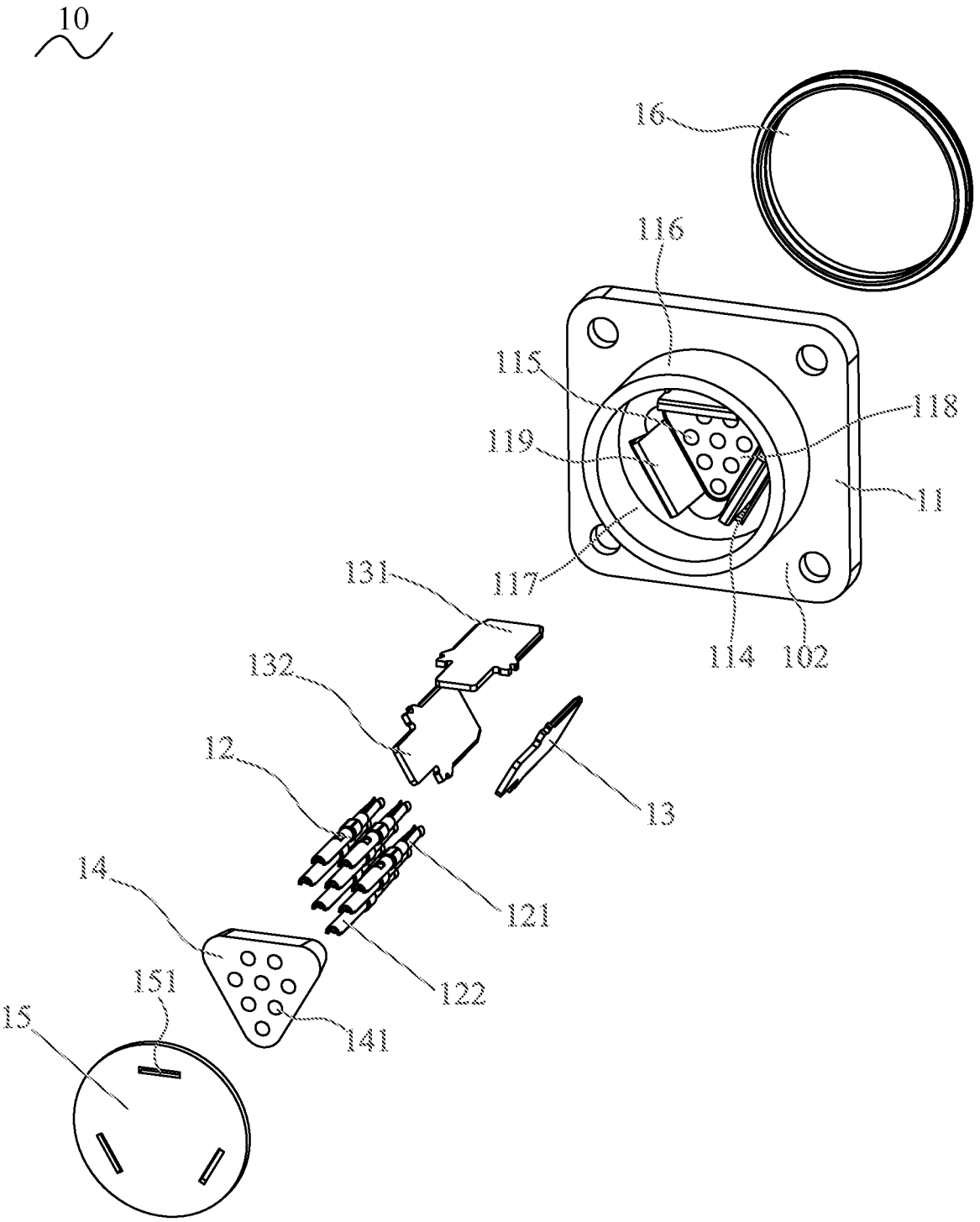
FIG. 7 is an exploded view of a first connector of the electrical connector assembly of FIG. 1.
Figure 8:
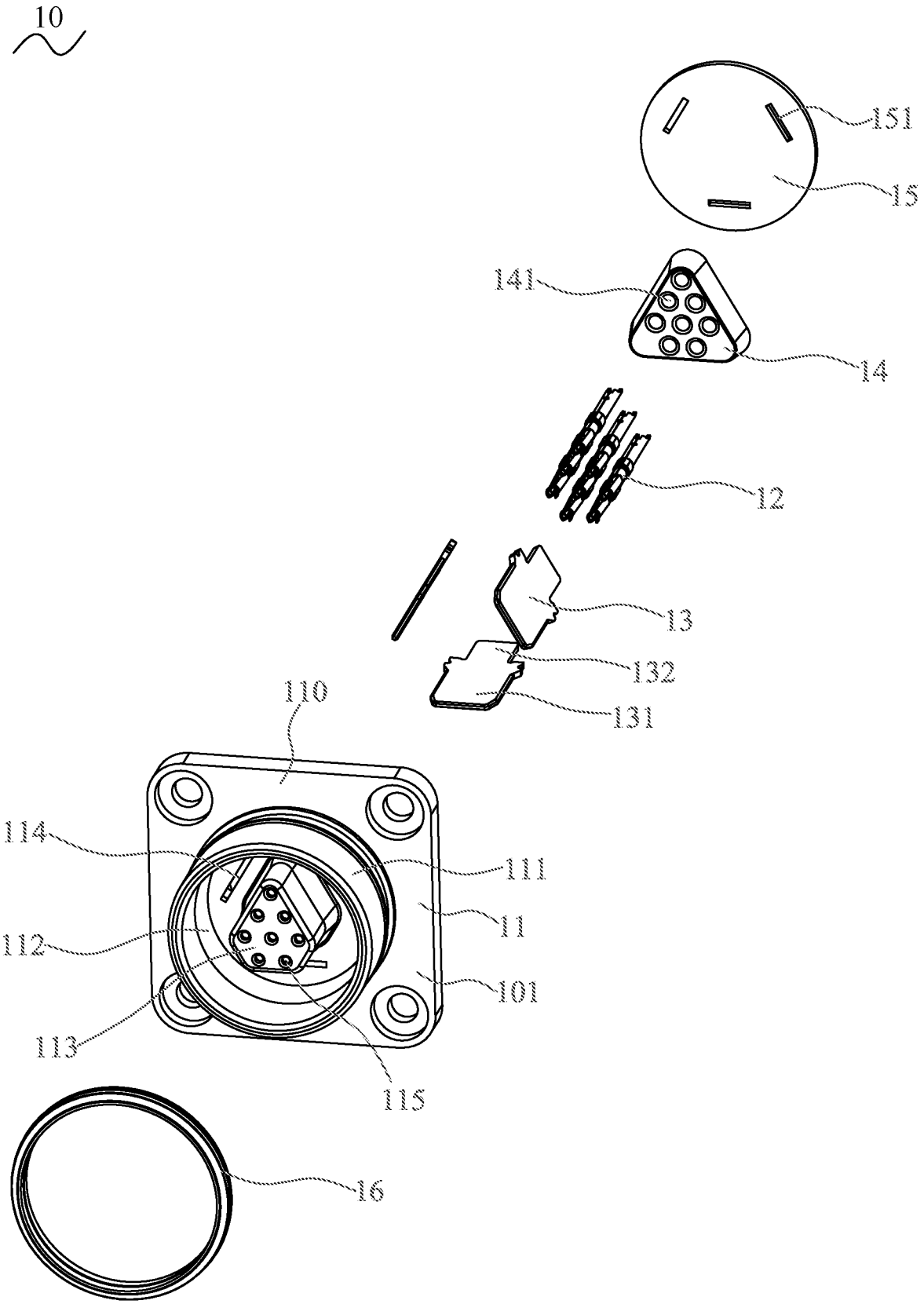
FIG. 8 is another exploded view of the first connector of the electrical connector assembly of FIG. 1.
Figure 9:
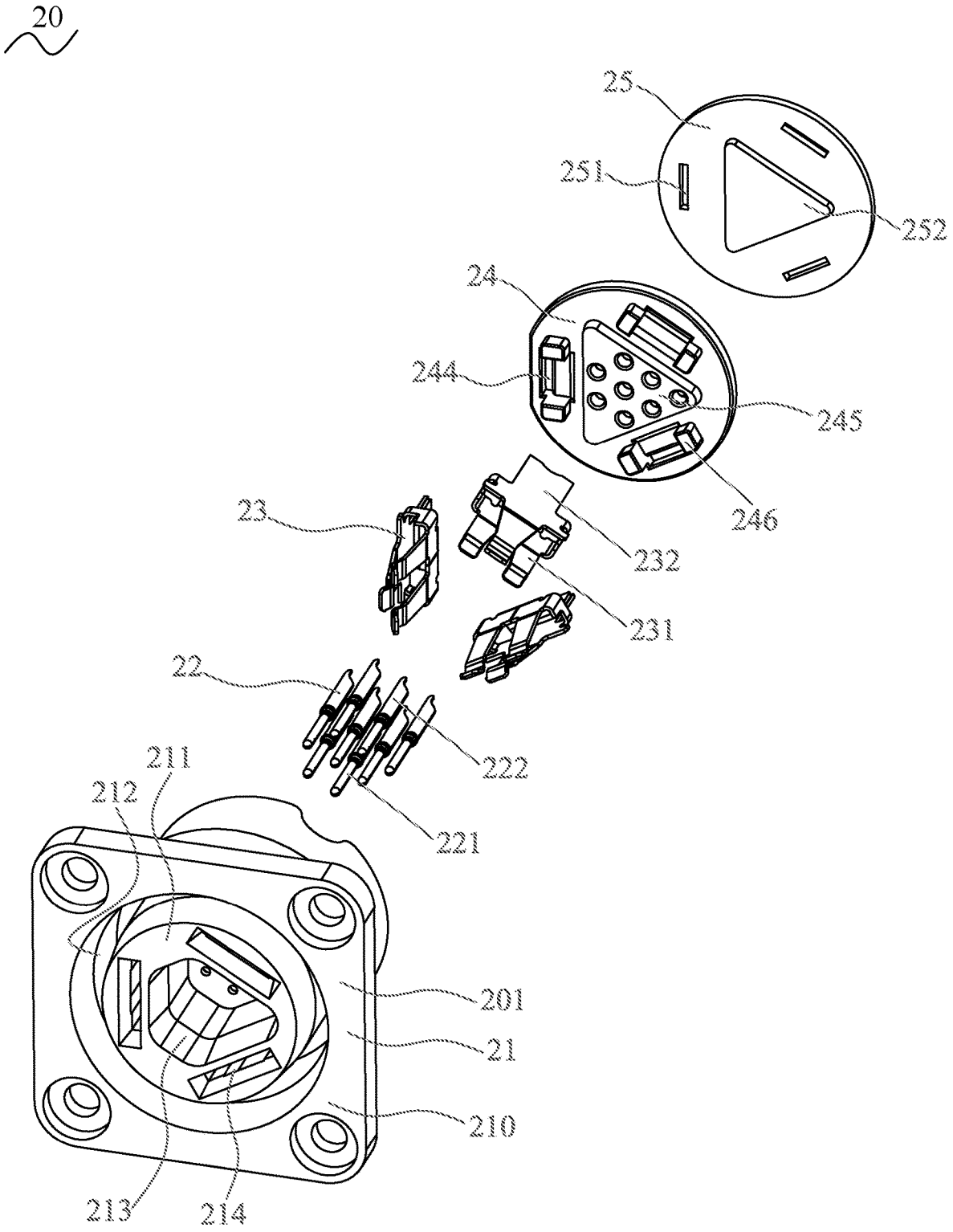
FIG. 9 is an exploded view of a second connector of the electrical connector assembly of FIG. 1.

Referring to FIG. 7 to FIG. 10 again, the plurality of the second signal terminals 22 are assembled to the second insulating housing 21. Each second signal terminal 22 is shown as a column shape. Each second signal terminal 22 has a third contact portion 221 and a third soldering portion 222. The plurality of the first signal terminals 12 are corresponding to the plurality of the second signal terminals 22. A front end of each second signal terminal 22 has the third soldering portion 222 extending opposite to the first insulating housing 11 and extending towards the inside of the second peripheral wall 216. The second peripheral wall 216 surrounds the third soldering portions 222 of the plurality of the second signal terminals 22. The third soldering portion 222 of each second signal terminal 22 is used for being soldered with the wire. The third soldering portion 222 of each second signal terminal 22 is exposed out of an outer surface of the second glue body 25. The third soldering portion 222 of each second signal terminal 22 is exposed to and projects beyond a front surface of the second glue body 25. A rear end of each second signal terminal 22 has the third contact portion 221 extending towards the first insulating housing 11 and exposed to the docking groove 213. A middle of each second power terminal 23 is hid in a middle of the second insulating housing 21. The front end of each second signal terminal 22 is exposed to the front end of the second insulating housing 21, and the rear end of each second signal terminal 22 is exposed to the rear end of the second insulating housing 21. The third contact portions 221 of the plurality of the second signal terminals 22 are corresponding to the first contact portions 121 of the plurality of the first signal terminals 12.

The plurality of the second power terminals 23 are assembled to the second insulating housing 21. Extension directions of the plurality of the second power terminals 23 in the second insulating housing 21 are multiple directions and are arranged along the direction of the periphery of the polygon. The extension directions of the plurality of the second power terminals 23 in the second insulating housing 21 are at least three directions. The extension directions of the plurality of the second power terminals 23 in the second insulating housing 21 are different, so the angle is formed between each two second power terminals 23 in the second insulating housing 21. In the preferred embodiment, each second power terminal 23 is shown as another clamping structure and is disposed longitudinally. Each second power terminal 23 has a clamping portion 231 and a fourth soldering portion 232. The plurality of the second power terminals 23 correspondingly contact with and clamp the plurality of the first power terminals 13. A rear end of each second power terminal 23 has the clamping portion 231 extending towards the first insulating housing 11. Rear ends of the plurality of the second power terminals 23 are hid in the bearing portion 211. The clamping portion 231 of each second power terminal 23 is disposed in one second power terminal groove 214. The clamping portions 231 of the plurality of the second power terminals 23 clamp the second contact portions 131 of the plurality of the first power terminals 13. A front end of each second power terminal 23 has the fourth soldering portion 232 extending opposite to the first insulating housing 11 and extending towards the inside of the second peripheral wall 216. The front end of each second power terminal 23 is exposed to the front end of the second insulating housing 21, and the rear end of each second power terminal 23 is exposed to the rear end of the second insulating housing 21. The second peripheral wall 216 surrounds the fourth soldering portions 232 of the plurality of the second power terminals 23. The fourth soldering portion 232 of each second power terminal 23 is used for being soldered with the wire. In the preferred embodiment, the fourth soldering portion 232 of each second power terminal 23 is exposed out of the outer surface of the second glue body 25. The fourth soldering portion 232 of each second power terminal 23 is exposed to and projects beyond the front surface of the second glue body 25. The plurality of the second power terminals 23 are disposed in the second insulating housing 21 along the different angles with respect to the horizontal plane.

Figure 10:
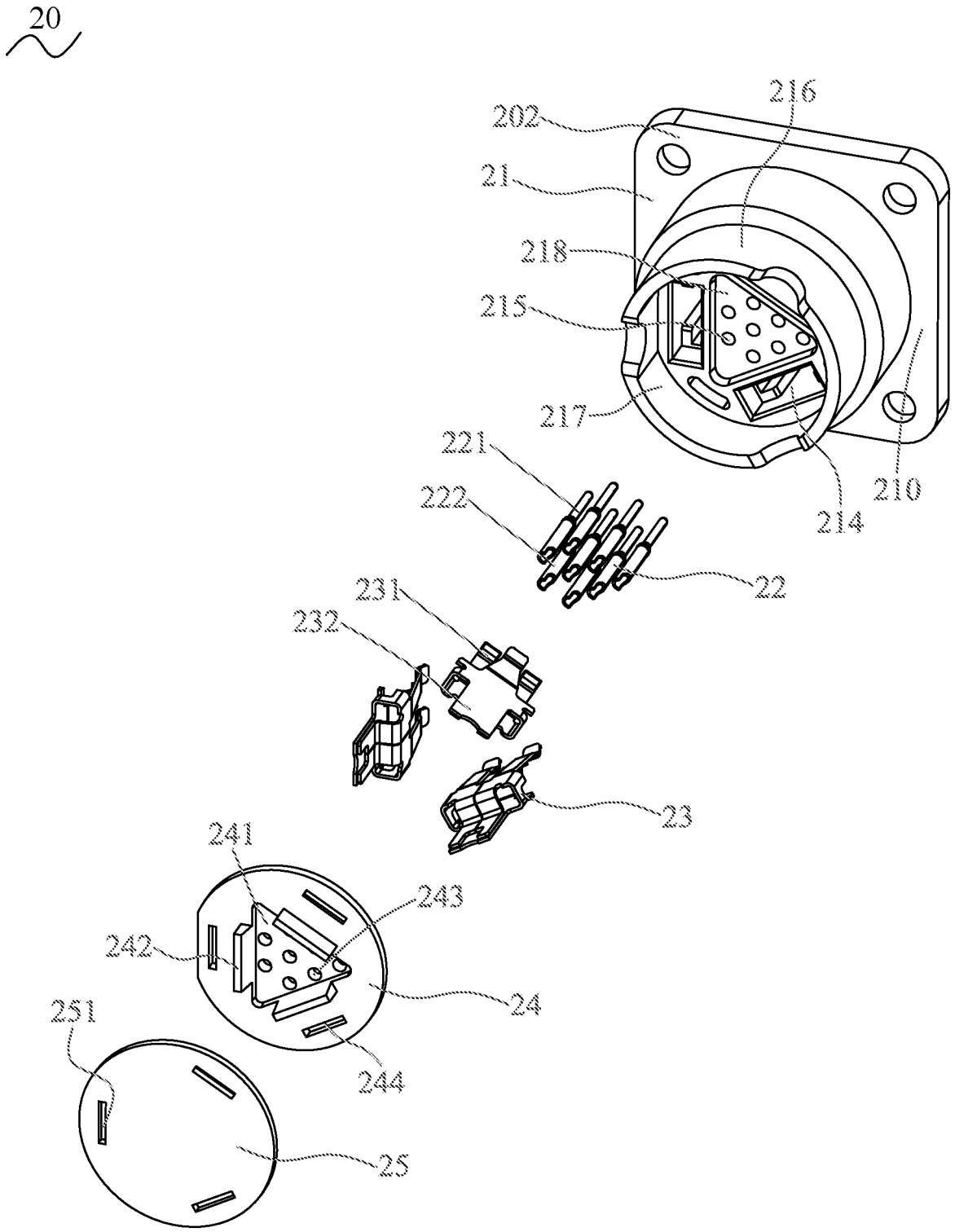
FIG. 10 is another exploded view of the second connector of the electrical connector assembly of FIG. 1.

Referring to FIG. 9 and FIG. 10, the middle of the rear of the second back cover 24 is disposed on the second concave surface 218 of second insulating housing 21. The second back cover 24 is used for fastening the plurality of the second signal terminals 22. The second back cover 24 has a third concave surface 241, a plurality of second blocking walls 242, a plurality of second perforations 243, a plurality of second penetrating grooves 244, a first protruding block 245 and a plurality of fastening portions 246. A middle of an outer surface of the second back cover 24 is recessed towards the second insulating housing 21 to form the third concave surface 241. Several portions of the middle of the outer surface of the second back cover 24 extends outward to form the plurality of the second blocking walls 242. The plurality of the second blocking walls 242 are averagely distributed around the middle of the outer surface of the second back cover 24. The third concave surface 241 is disposed among the plurality of the second blocking walls 242. In the preferred embodiment, the second back cover 24 has three second blocking walls 242 averagely distributed around the middle of the outer surface of the second back cover 24. Each second blocking wall 242 is used for reducing the wire overlap soldering and increasing the creepage distance. A front surface of the second back cover 24 is defined as the outer surface of the second back cover 24.

Referring to FIG. 1 to FIG. 10, the second back cover 24 has the plurality of the second perforations 243 penetrating through the front surface and a rear surface of the second back cover 24. The third soldering portion 222 of each second signal terminal 22 penetrates through one second perforation 243 and is exposed out of the outer surface of the second glue body 25. The plurality of the second penetrating grooves 244 penetrate through the front surface and the rear surface of the second back cover 24. The plurality of the second penetrating grooves 244 surround the third concave surface 241, the plurality of the second perforations 243 and the plurality of the second blocking walls 242. The plurality of the second penetrating grooves 244 are corresponding to the plurality of the second blocking walls 242. The plurality of the second blocking walls 242 are disposed between the plurality of the second penetrating grooves 244 and the plurality of the second perforations 243. The plurality of the second perforations 243 are formed in the third concave surface 241.

In the preferred embodiment, the plurality of the second signal terminals 22 are corresponding to the plurality of the second signal terminal grooves 215 and the plurality of the second perforations 243. A quantity of the plurality of the second signal terminals 22, a quantity of the plurality of the second signal terminal grooves 215 and a quantity of the plurality of the second perforations 243 are the same. In the preferred embodiment, the second back cover 24 has eight second perforations 243. The second back cover 24 has three second penetrating grooves 244 averagely distributed in the second back cover 24.

A middle of the rear surface of the second back cover 24 extends towards the second concave surface 218 of the second insulating housing 21 to form the first protruding block 245. The first protruding block 245 is fastened on the second concave surface 218 of the second insulating housing 21, so the second back cover 24 is fastened in the second insulating housing 21. Several portions of the rear surface of the second back cover 24 extend towards the plurality of the second power terminal grooves 214 of the second insulating housing 21 to form the plurality of the fastening portions 246. Each second penetrating groove 244 is located to and adjacent to one fastening portion 246. A quantity of the plurality of the fastening portions 246 is corresponding to a quantity of the plurality of the second power terminals 23. The plurality of the fastening portions 246 are used for fastening positions of the plurality of the second power terminals 23. One end of each second power terminal 23 penetrates through one second penetrating groove 244, and then the one end of each second power terminal 23 is buckled with and fastened to the one fastening portion 246. In the preferred embodiment, the second back cover 24 has three fastening portions 246. The plurality of the fastening portions 246 are filled in the plurality of the second power terminal grooves 214.

The second glue body 25 is disposed in the second peripheral wall 216 of the second insulating housing 21 and is covered to the second back cover 24. The second glue body 25 fills up second gaps 203 among the plurality of the second signal terminals 22, the plurality of the second power terminals 23 and the plurality of the second blocking walls 242 of second back cover 24. The second glue body 25 is used for a waterproof function. The second glue body 25 has a plurality of third penetrating grooves 251 and a second protruding block 252. The plurality of the third penetrating grooves 251 penetrate through the front surface and a rear surface of the second glue body 25. The plurality of the second power terminals 23 are corresponding to the plurality of the second power terminal grooves 214 and the plurality of the third penetrating grooves 251. The plurality of the third penetrating grooves 251 are averagely distributed in the second glue body 25. A quantity of the plurality of the third penetrating grooves 251, the quantity of the plurality of the second power terminal grooves 214 and the quantity of the plurality of the second power terminals 23 are the same.

In the preferred embodiment, the second glue body 25 has three third penetrating grooves 251 averagely distributed in the second glue body 25. A middle of the rear surface of the second glue body 25 extends towards the second back cover 24 to form the second protruding block 252. The second protruding block 252 is disposed among the plurality of the third penetrating grooves 251. The second protruding block 252 is fastened to and buckled to the third concave surface 241, so the second glue body 25 is fastened to a front of the second back cover 24. In the preferred embodiment, the third soldering portion 222 of each second signal terminal 22, the fourth soldering portion 232 of each second power terminal 23 and each second blocking wall 242 are partially exposed out of the outer surface of the second glue body 25. The third soldering portion 222 of each second signal terminal 22, the fourth soldering portion 232 of each second power terminal 23 and each second blocking wall 242 are partially exposed to and project beyond the front surface of the second glue body 25. The electrical connector assembly 100 is a vehicle-used electrical connector assembly.

As described above, the first contact portion 121 of each first signal terminal 12 is disposed in the protrusion 113 of the first insulating housing 11, the second contact portion 131 of each first power terminal 13 is exposed to the fastening groove 112 of the first insulating housing 11, so the plurality of the first signal terminals 12 and the plurality of the first power terminals 13 are partially exposed outside at the different positions, the plurality of the first signal terminals 12 are disposed among the plurality of the first power terminals 13, each first power terminal 13 has the shielding function for isolating an external signal interference to prevent each first signal terminal 12 from being interfered, and simultaneously, the third contact portion 221 of each second signal terminal 22 is exposed to the docking groove 213 of the second insulating housing 21, the clamping portion 231 of each second power terminal 23 is disposed in the second power terminal groove 214 of the bearing portion 211, so the plurality of the second signal terminals 22 and the plurality of the second power terminals 23 are partially exposed outside at the different positions, the plurality of the second signal terminals 22 are disposed among the plurality of the second power terminals 23, each second power terminal 23 has the shielding function for isolating the external signal interference to prevent each second signal terminal 22 from being interfered. Moreover, when the first connector 10 is docked with the second connector 20, the plurality of the first signal terminals 12 are corresponding to the plurality of the second signal terminals 22, the plurality of the first power terminals 13 correspondingly contact with and clamp the plurality of the second power terminals 23, the protrusion 113 of the first insulating housing 11 is corresponding to the docking groove 213 of the second insulating housing 21, and the protrusion 113 is received in the docking groove 213. The front ends of the plurality of the first signal terminals 12 are corresponding to the rear ends of the plurality of the second signal terminals 22, and the rear ends of the plurality of the second power terminals 23 correspondingly contact with and clamp the front ends of the plurality of the first power terminals 13. As a result, the electrical connector assembly 100 has the plurality of the power terminals 105 and the plurality of the signal terminals 104 partially exposed outside at the different positions, so the plurality of the power terminals 105 and the plurality of the signal terminals 104 are easily assembled in proper positions to be protected, the positions of the first connector 10 and the second connector 20 are aligned easily at the time of the first connector 10 being docked with the second connector 20 to further protect the plurality of the signal terminals 104 and the power terminals 105 to make the plurality of the signal terminals 104 and the power terminals 105 be hardly damaged.

What is claimed is:

1. An electrical connector assembly, comprising:

a first connector, including:

a first insulating housing, a front end and a rear end of the first insulating housing being opened freely;

a plurality of first signal terminals disposed in the first insulating housing, a front end of each first signal terminal being exposed to the front end of the first insulating housing, and a rear end of each first signal terminal being exposed to the rear end of the first insulating housing; and a plurality of first power terminals disposed in the first insulating housing, a front end of each first power terminal being exposed to the front end of the first insulating housing, and a rear end of each first power terminal being exposed to the rear end of the first insulating housing, each first power terminal being shown as a flat plate shape, extension directions of the plurality of the first power terminals in the first insulating housing being at least three directions, each direction is formed by an angle which being formed between each two first power terminals in the first insulating housing, and the plurality of the first power terminals surrounding the plurality of the first signal terminals; and a second connector docked with the first connector, the second connector including:

a second insulating housing, a front end and a rear end of the second insulating housing being opened freely;

a plurality of second signal terminals disposed in the second insulating housing, a front end of each second signal terminal being exposed to the front end of the second insulating housing, and a rear end of each second signal terminal being exposed to the rear end of the second insulating housing; and a plurality of second power terminals disposed in the second insulating housing, a front end of each second power terminal being exposed to the front end of the second insulating housing, and a rear end of each second power terminal being exposed to the rear end of the second insulating housing, each second power terminal being shown as a clamping structure, extension directions of the plurality of the second power terminals in the second insulating housing being multiple directions and being arranged along the direction of the periphery of the polygon, the plurality of the second power terminals surrounding the plurality of the second signal terminals, the plurality of the first signal terminals being corresponding to the plurality of the second signal terminals, the plurality of the second power terminals correspondingly contacting with and clamping the plurality of the first power terminals, wherein:

the first insulating housing has a first base body, the first base body has a first docking surface, and a first connecting surface opposite to the first docking surface, a middle of the first docking surface of the first base body extends toward the second connector to form a docking portion, the docking portion is shown as a hollow cylinder shape, the hollow docking portion and the first base body surround a fastening groove between the docking portion and the first docking surface of the first base body, the middle of the first docking surface of the first base body extends towards the second connector to form a protrusion, the protrusion is disposed in the fastening groove, a front end of the first power terminal exposed out the fastening groove, the front end of each first signal terminal is disposed in the protrusion, the front end of each first power terminal is exposed in the fastening groove.

2. The electrical connector assembly as claimed in claim 1, wherein the second insulating housing has a second base body, the second base body has a second docking surface, and a second connecting surface opposite to the second docking surface, a middle of the second docking surface of the second base body is recessed towards an inside of the second base body to form a receiving groove, a middle of a front wall of the receiving groove protrudes rearward to form a bearing portion disposed in the receiving groove, the fastening groove of the first insulating housing is corresponding to the bearing portion, the docking portion of the first insulating housing is corresponding to the receiving groove, a middle of a rear surface of the bearing portion is recessed towards the inside of the second base body to form a docking groove, the protrusion of the first insulating housing is corresponding to and matched with the docking groove, rear ends of the plurality of the second signal terminals are exposed to the docking groove, rear ends of the plurality of the second power terminals are hid in the bearing portion.

3. The electrical connector assembly as claimed in claim 2, wherein the second insulating housing has a plurality of second power terminal grooves penetrating through the rear surface of the bearing portion and the second connecting surface of the second base body, the docking groove is disposed among the plurality of the second power terminal grooves, the plurality of the second power terminals are disposed in the plurality of the second power terminal grooves.

4. The electrical connector assembly as claimed in claim 3, wherein the first base body has a plurality of first power terminal grooves penetrating through the first docking surface and the first connecting surface of the first base body, the plurality of the first power terminal grooves are disposed inside the docking portion, front ends of the plurality of the first power terminal grooves are located in the fastening groove, the protrusion is disposed among the plurality of the first power terminal grooves, the plurality of the first power terminals are disposed to and penetrate through the plurality of the first power terminal grooves, the front end of each first power terminal is exposed in the fastening groove of the docking portion, the first insulating housing has a plurality of first signal terminal grooves penetrating through a front surface of the protrusion and the first connecting surface of the first base body, front ends of the plurality of the first signal terminals are disposed in the plurality of the first signal terminal grooves and are surrounded by the protrusion, rear ends of the plurality of the first signal terminals penetrate through the plurality of the first signal terminal grooves and are exposed beyond the first connecting surface of the first base body.

5. The electrical connector assembly as claimed in claim 4, wherein the first connector includes a first back cover, a first glue body and a sealing ring, the first back cover and the first glue body are disposed in the first insulating housing, the first glue body is covered to the first back cover, the second connector includes a second back cover and a second glue body, the second back cover and the second glue body are disposed in the second insulating housing, the sealing ring is mounted around an outer surface of the docking portion, the sealing ring is located between the first connector and the second connector.

6. The electrical connector assembly as claimed in claim 5, wherein a middle of the first connecting surface of the first base body extends rearward to form a first peripheral wall shown as an annular shape, the first back cover and the first glue body are disposed inside the first peripheral wall, the first insulating housing has a fixing groove formed between an inner surface of the first peripheral wall and the first connecting surface of the first base body, the middle of the first connecting surface of the first base body is recessed inward to form a first concave surface opposite to the docking portion, the first concave surface is surrounded by the first peripheral wall, the first concave surface is formed to an inner surface of a front wall of the fixing groove, the first back cover is fastened on the first concave surface, several portions of the middle of the first connecting surface of the first base body extends rearward to form a plurality of first blocking walls, the plurality of the first blocking walls are disposed inside the first peripheral wall, and the plurality of the first blocking walls are disposed in the fixing groove, the first concave surface is disposed among the plurality of the first blocking walls, the plurality of the first blocking walls are disposed between the plurality of the first signal terminals and the plurality of the first power terminals.

7. The electrical connector assembly as claimed in claim 6, wherein a middle of the second connecting surface of the second base body extends frontward to form a second peripheral wall shown as another annular shape, an inside of the second peripheral wall has a locating groove, a middle of a front surface of a rear wall of the locating groove is recessed inward and towards the second base body to form a second concave surface, the second concave surface is disposed inside the second peripheral wall, the second concave surface is formed to an inner surface of the rear wall of the locating groove, the second back cover is mounted on the second concave surface.

8. The electrical connector assembly as claimed in claim 7, wherein a middle of an outer surface of the second back cover is recessed towards the second insulating housing to form a third concave surface, several portions of the middle of the outer surface of the second back cover extend outward to form a plurality of the second blocking walls, the third concave surface is disposed among the plurality of the second blocking walls, the plurality of the second blocking walls are averagely distributed around the middle of the outer surface of the second back cover.

9. The electrical connector assembly as claimed in claim 8, wherein the first back cover has a plurality of first perforations penetrating through a front surface and a rear surface of the first back cover, the plurality of the first perforations are corresponding to the plurality of the first signal terminal grooves and the plurality of the first signal terminals, the first glue body has a plurality of first penetrating grooves penetrating through a front surface and a rear surface of the first glue body, the plurality of the first penetrating grooves are averagely distributed in the first glue body, the plurality of the first penetrating grooves are corresponding to the plurality of the first power terminal grooves and the plurality of the first power terminals.

10. The electrical connector assembly as claimed in claim 9, wherein the second back cover has a plurality of second perforations penetrating through a front surface and a rear surface of the second back cover, the second back cover has a plurality of second penetrating grooves penetrating through a front surface and a rear surface of the second back cover, the plurality of the second penetrating grooves are corresponding to the plurality of the second blocking walls, the plurality of the second blocking walls are disposed between the plurality of the second penetrating grooves and the plurality of the second perforations, the plurality of the second perforations are formed in the third concave surface.

11. The electrical connector assembly as claimed in claim 10, wherein a middle of the rear surface of the second back cover extends towards the second concave surface to form a first protruding block, the first protruding block is fastened on the second concave surface of the second insulating housing, several portions of the rear surface of the second back cover extend towards the plurality of the second power terminal grooves to form a plurality of the fastening portions, a quantity of the plurality of the fastening portions is corresponding to a quantity of the plurality of the second power terminals.

12. The electrical connector assembly as claimed in claim 11, wherein the second back cover and the second glue body are disposed inside the second peripheral wall, and the second glue body is covered to the second back cover, the second glue body has a plurality of third penetrating grooves penetrate through a front surface and a rear surface of the second glue body, the plurality of the third penetrating grooves being averagely distributed the second glue body, the rear surface of the second glue body extends towards the second back cover to form a second protruding block, the second protruding block is disposed among the plurality of the third penetrating grooves, the second protruding block is buckled to the third concave surface.

13. The electrical connector assembly as claimed in claim 6, wherein the rear end of each first signal terminal has a first soldering portion extending towards an inside of the first peripheral wall, the first soldering portion of each first signal terminal is partially exposed out of an outer surface of the first glue body, the rear end of each first power terminal has a second soldering portion extending towards the inside of the first peripheral wall, the second soldering portion of each first power terminal is partially exposed out of the outer surface of the first glue body.

14. The electrical connector assembly as claimed in claim 13, wherein the front end of each first signal terminal has a first contact portion extending towards the second insulating housing of the second connector, the first contact portion of each first signal terminal is disposed in the protrusion, the front end of each first power terminal has a second contact portion extending towards the second insulating housing, the second contact portion of each first power terminal is exposed to the fastening groove, the rear end of each second signal terminal has a third contact portion extending towards the first insulating housing and exposed to the docking groove, the third contact portions of the plurality of the second signal terminals are corresponding to the first contact portions of the plurality of the first signal terminals, the rear end of each second power terminal has a clamping portion extending towards the first insulating housing, the clamping portion of each second power terminal is disposed in one second power terminal groove, the clamping portions of the plurality of the second power terminals clamp the second contact portions of the plurality of the first power terminals.

15. The electrical connector assembly as claimed in claim 14, wherein a middle of the second connecting surface of the second base body protrudes frontward to form a second peripheral wall shown as another annular shape, the second back cover and the second glue body are disposed inside the second peripheral wall, an inside of the second peripheral wall has a locating groove recessed towards the second base body, a middle of an inner surface of a rear wall of the locating groove is recessed inward and towards the second base body to form a second concave surface, the second concave surface is disposed inside the second peripheral wall.

16. The electrical connector assembly as claimed in claim 15, wherein the front end of each second signal terminal has a third soldering portion extending towards the inside of the second peripheral wall, the third soldering portion of each second signal terminal is exposed out of an outer surface of the second glue body, the front end of each second power terminal has a fourth soldering portion extending towards the inside of the second peripheral wall, the fourth soldering portion of each second power terminal is exposed out of the outer surface of the second glue body.

17. The electrical connector assembly as claimed in claim 1, wherein the plurality of the first power terminals are without being parallel to one another, and the plurality of the first power terminals are without being perpendicular to one another.

18. An electrical connector assembly, comprising:

a first connector, including:

a first insulating housing having a first base body, the first base body having a first docking surface, and a first connecting surface opposite to the first docking surface, a middle of the first docking surface of the first base body extending frontward to form a docking portion, the middle of the first docking surface of the first base body extending frontward to form a protrusion, the docking portion surrounding and spaced from the protrusion, the docking portion and the first base body surrounding a fastening groove between the docking portion and the first docking surface of the first base body;

a plurality of first signal terminals disposed in the first insulating housing, a front end of each first signal terminal having a first contact portion, the first contact portion of each first signal terminal being disposed in the protrusion; and a plurality of first power terminals disposed in the first insulating housing, the plurality of the first power terminals surrounding and spaced from the plurality of the first signal terminals, extension directions of the plurality of the first power terminals in the first insulating housing being at least three directions, and an angle being formed between each two first power terminals in the first insulating housing, a front end of each first power terminal having a second contact portion, the second contact portion of each first power terminal being exposed to the fastening groove of the first insulating housing; and a second connector docked with the first connector, the second connector including:

a second insulating housing having a second base body, the second base body having a second docking surface, and a second connecting surface opposite to the second docking surface, a middle of the second docking surface being recessed inward and towards an inside of the second base body to form a receiving groove, a middle of a front wall of the receiving groove protruding rearward to form a bearing portion, the fastening groove being corresponding to the bearing portion, the docking portion being corresponding to the receiving groove, a middle of a rear surface of the bearing portion being recessed inward and towards the inside of the second base body to form a docking groove, the protrusion corresponding to and matched with the docking groove;

a plurality of second signal terminals disposed in the second insulating housing, a rear end of each second signal terminal having a third contact portion, the third contact portion of each second signal terminal being exposed to the docking groove; and a plurality of second power terminals disposed in the second insulating housing, the plurality of the second power terminals surrounding and spaced from the plurality of the second signal terminals, extension directions of the plurality of the second power terminals in the second insulating housing being at least three directions, so the angle being formed between each two second power terminals in the second insulating housing, a rear end of each second power terminal having a clamping portion, the clamping portion of each second power terminal being disposed in the bearing portion, the clamping portions of the plurality of the second power terminals clamping the second contact portions of the plurality of the first power terminals, the third contact portions of the plurality of the second signal terminals being corresponding to the first contact portions of the plurality of the first signal terminals.

* * * * *